United States Patent [19]

Hawkins

[11] 4,440,973

[45] * Apr. 3, 1984

[54] COAXIAL CABLES

[75] Inventor: Richard E. Hawkins, Colchester, Vt.

[73] Assignee: Champlain Cable Corporation, Wilmington, Del.

[ * ] Notice: The portion of the term of this patent subsequent to Jun. 1, 1999 has been disclaimed.

[21] Appl. No.: 358,955

[22] Filed: Mar. 17, 1982

Related U.S. Application Data

[63] Continuation of Ser. No. 156,545, Jun. 5, 1980.

[51] Int. Cl.[3] ..... H01B 7/18

[52] U.S. Cl. ..... 174/107; 156/56; 174/36; 174/102 R; 174/111; 174/120 SR; 174/121 SR

[58] Field of Search ..... 174/36, 102, 107, 110 FC, 174/111, 113 AS, 120 SR, 121 SR; 128/383; 156/56; 428/473.5, 477.7

[56] References Cited

U.S. PATENT DOCUMENTS

| | | | |
|---|---|---|---|
| 2,585,484 | 2/1952 | Menes | 174/111 |
| 3,309,458 | 3/1967 | Yoshimura et al. | 174/107 |
| 3,425,865 | 2/1969 | Shelton, Jr. | 174/121 R |
| 3,573,976 | 4/1971 | Duane | 117/217 |
| 3,616,177 | 10/1971 | Gumerman | 174/110 FC X |
| 3,681,515 | 8/1972 | Mildner | 174/107 |
| 3,887,761 | 6/1975 | Gore | 174/110 FC X |
| 3,968,463 | 7/1976 | Boysen | 333/96 |
| 4,045,611 | 8/1977 | Torgerson | 174/121 SR |
| 4,107,354 | 8/1978 | Wilkenloh et al. | 427/118 |
| 4,184,001 | 1/1980 | Hildreth | 428/383 |
| 4,273,829 | 6/1981 | Perreault | 174/110 FC X |
| 4,319,940 | 3/1982 | Arrogo et al. | 174/110 FC X |
| 4,332,976 | 6/1982 | Hawkins | 174/107 |
| 4,340,773 | 7/1982 | Perreault | 174/107 |

*Primary Examiner*—J. V. Truhe
*Assistant Examiner*—Morris H. Nimmo
*Attorney, Agent, or Firm*—Joanne L. Horn

[57] ABSTRACT

A dielectric system for coaxial electrical conductors is provided. The dielectric system separates an inner and outer conductor and is composed of a first layer of braided high tensile strength polymeric fluorocarbon filaments in an open weave surrounding the inner conductor. Surrounding the layer of braided filaments is a continuous layer of a polymeric film which is in turn surrounded by a continuous layer of a crosslinkable polymeric lacquer enclosing both the layer of braided filaments and the layer of polymeric film.

9 Claims, 1 Drawing Figure

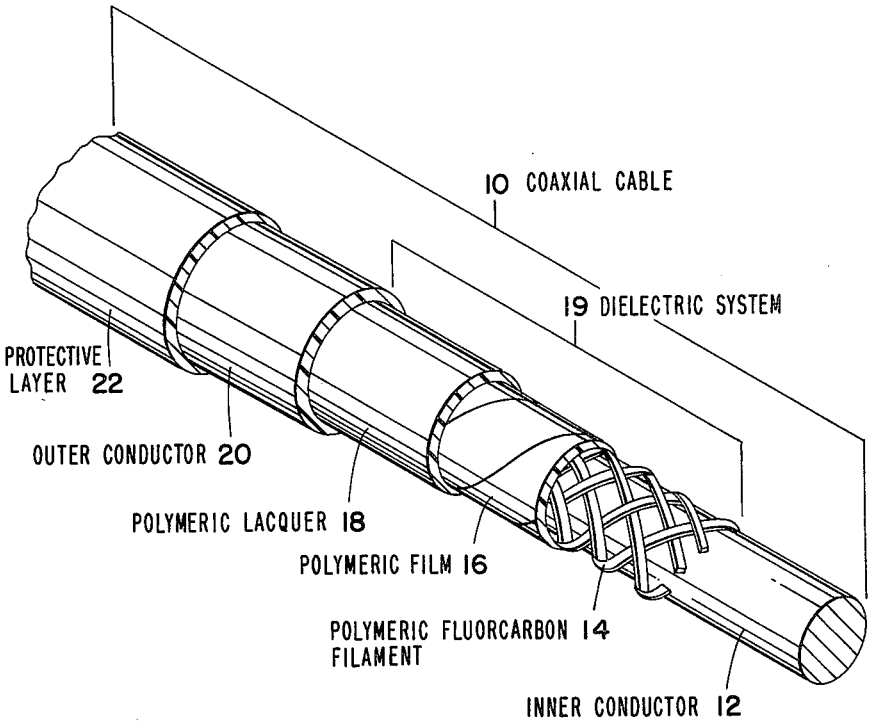
10 COAXIAL CABLE
19 DIELECTRIC SYSTEM
PROTECTIVE LAYER 22
OUTER CONDUCTOR 20
POLYMERIC LACQUER 18
POLYMERIC FILM 16
POLYMERIC FLUORCARBON 14 FILAMENT
INNER CONDUCTOR 12

COAXIAL CABLES

This is a continuation of application Ser. No. 156,545, filed June 5, 1980.

SUMMARY OF THE INVENTION

The present invention relates to a dielectric system for use in a coaxial cable. In particular, the present invention relates to a dielectric system for coaxial electrical conductors which separates an inner and an outer conductive material and which comprises a first layer of braided high tensile strength polymeric fluorocarbon filaments in an open weave surrounding an inner conductor along its length, a second layer overlying the braided filament layer consisting of a continuous skin of polymeric film, and a third layer overlying the second layer consisting of a continuous skin of crosslinkable polymeric lacquer.

BACKGROUND OF THE INVENTION

A coaxial cable is usually comprised of an inner conductive member, a dielectric system surrounding the inner conductor, and an outer conductive member coaxially surrounding the dielectric system. The inner conductive member and the outer conductive members are made with some appropriate metal, most commonly copper, aluminum or some alloy containing such metal. The dielectric system is usually composed of some suitable plastic, and use of polyethylene, polystyrene, and polypropylene, in expanded or unexpanded form, is common.

The best dielectric, from a theoretical standpoint, would be a layer of air, which has a dielectric constant of 1.0. It is virtually impossible to construct such a cable, however, and commercial cables employ solid materials with necessarily higher dielectric constants. The higher the dielectric constant of the material, the lower the velocity of propagation of the coaxial cable as a whole, and thus, the longer the cable will take to transmit an electrical signal along its length. In addition to improved velocity of propagation, a lower dielectric constant will allow a thinner insulation layer which should produce a smaller finished cable diameter. This becomes important in applications which have space or weight limitations.

One method which has been followed in attempting to increase the velocity of propagation of a cable has been to decrease the effective dielectric constant by introducing air or other materials into an otherwise solid dielectric layer.

In U.S. Pat. No. 3,309,458, a coaxial conductor is shown which employs as a dielectric a two-layer system. The first layer of the system is comprised of a brittle foamed synthetic resin and the second layer is composed of a non-foamed synthetic resin which is pliable in comparison with the foamed resin.

In U.S. Pat. No. 3,573,976, a coaxial cable is provided in which the dielectric is extruded from a combination of glass, silica or ceramic microspheres; a suspension of powdered polyethylene or polymeric fluorocarbon resin; a volatile ethylene dichloride or trichloroethylene carrier and a tackifying agent of polyisobutylene or hexafluoropropylene-vinylidene fluoride copolymer. The microspheres, or microballoons as they are also known, are discrete, hollow, spherical particles, and the effective dielectric constant of the dielectric system is reduced according to the amount of air encapsulated therein.

U.S. Pat. No. 3,968,463 discloses a coaxial cable having as a dielectric coating on the core conductor, an extruded cellular ethylene or propylene polymer based composition.

U.S. Pat. No. 4,107,354 is directed to a method of forming a coaxial cable by coating a center conductor of the cable with a dielectric composed of cellular polyolefin.

The problem which has been encountered with coaxial cables employing foamed dielectric systems is that as the amount of foaming, and therefore the amount of encapsulated air, is increased, the mechanical and heat resistance properties of the cable are adversely affected. To provide sufficient mechanical strength, cables must have diminished flexibility or increased size, and this limits the applications for which the cable may be used.

Another method used to incorporate air into the dielectric system has been through the use of disk type insulating separators. Following this method, disk type insulating separators of a material such as polyethylene are fitted onto an inner conductor at spaced intervals, thereby leaving air filled interstitial spaces. Such construction, however, lacks mechanical strength, particularly when the coaxial cable is bent, and the cables must be handled with great care.

It is an object of the present invention to provide a dielectric system for a coaxial cable which has a low effective dielectric constant.

It is a further object of the present invention to provide a dielectric system for a coaxial cable which has a low effective dielectric constant, but which has sufficient mechanical strength to allow substantial flexibility in the finished cable.

It is still a further object of the present invention to provide a dielectric system for a coaxial cable which has a low effective dielectric constant, but which has sufficient mechanical strength over a substantial range of temperatures to allow the construction of cables of very small diameter with consistent and predictable electrical characteristics, which are particularly useful in applications which call for miniaturized electrical conductors.

The foregoing, as well as other objects, features, and advantages of the present invention will become more apparent in light of the following detailed description of the preferred embodiment thereof and as illustrated in the accompanying drawings.

According to the present invention, there is provided a dielectric system for coaxial electrical conductors which separates an inner and outer conductive material. The dielectric system of the present invention comprises a first layer of braided high tensile strength polymeric fluorocarbon filaments in an open weave surrounding an inner conductor along its length. This layer of braided filaments is in turn covered by a second layer consisting of polymeric film, which provides a continuous skin over the weave of the braided filament layer. A third layer, consisting of a crosslinkable polymeric lacquer, surrounds the second layer and provides a continuous skin enclosing the second layer.

BRIEF DESCRIPTION OF THE DRAWING

The drawing shows a segment of a coaxial cable with the dielectric system of the present invention, having the various layers cut away for the purposes of illustration.

DETAILED DESCRIPTION OF THE PREFERRED EMBODIMENT

A typical coaxial conductor employing the dielectric system (19) of the present invention is shown in the drawing. The coaxial cable (10) has been cut away to show its various layers. An inner metallic conductor (12), sometimes referred to as a core, is shown as the central element, and is surrounded circumferentially by the dielectric system (19) of the present invention. This conductor may be constructed of copper or aluminum or some appropriate alloy, and may be in the form of a solid wire or a plurality of individual metallic strands wound together.

This inner conductor (12) is surrounded by a first layer of braided high tensile strength polymeric fluorocarbon filaments which create an open weave (14) about the said inner conductor (12). These filaments should have a tensile strength of at least 40,000 p.s.i., preferably in the range of 45,000 to 55,000 p.s.i., and they should have a dielectric constant of less than 2.8. A continuous layer (16) which may be composed of polyimide, polyparabanic acid, polyester or any similar thin, high tensile strength polymeric film which remains stable at temperatures up to 150° C. This polymeric film provides a continuous skin surrounding the layer of braided filaments (14) and helps to encapsulate air in the open weave of the braided filaments (14). It is advantageous to apply this layer in a solid form so as not to infiltrate the interstices of the braided layer in the place of the desired air. For this reason, the present invention contemplates the application of the material for this layer in the form of a continuous tape wrapped around the braided layer (14) by means well known to the art. However, the present invention is not meant to be limited to the application of this layer (16) by this means.

A continuous layer of crosslinkable polymeric lacquer (18) surrounds the polymeric film (16) and acts both as an adhesive, holding the inner layers in place, and as a sealant. This layer (18) represents the outermost layer of the dielectric system (19) of the present invention and may be applied by a dip coating technique or by other means known to the art.

To complete the cable, an outer conductor (20), which may be woven or solid, is disposed circumferentially about the dielectric system (19) of the present invention and said outer conductor (20) is typically surrounded circumferentially by a compatible protective layer (22) of a type well known to the art.

EXAMPLE 1

A small diameter coaxial cable for use in an application requiring miniature coaxial cable was fabricated with the dielectric system of the present invention in the following manner. A 30 AWG solid copper conductor with a 0.010 inch diameter was used as a central conductive member. Eight 0.005 inch filaments of ethylene-chlorotrifluoroethylene copolymer, available commercially from Allied Chemical under the Trademark Halar® were braided over said central conductor on a Wardwell Braiding Machine Company sixteen carrier braider to a density of 10 to 15 picks per inch.

Over the open weave braid thus produced, a layer of polyparabanic acid, commercially available from Exxon under the Trademark Tradlon® was applied. The polyparabanic acid was applied in the form of a thin tape, 0.001 inch in thickness and 0.125 inch in width, on an EJR Engineering tape-wrapping machine which is capable of providing accurate tension control. The tape was applied with a sufficient overlap, about 25%, to avoid separation when the cable is bent while still maintaining a small diameter in the dielectric system.

Over the polyparabanic acid layer, an acrylic topcoat layer was applied which acts as an adhesive and sealant. In this example, a thin coating of liquid methyl methacrylate containing a self-contained crosslinking agent, commercially available from the Rohm and Haas Company under the Trademark Rhoplex AC-1230®, was applied using a dip flow coating technique known to the art, and cured in a wire enameling oven. An outer conductive member and a protective layer of polymeric fluorocarbon were applied in a manner well known to the art.

The resulting cable demonstrated the following useful properties, which did not deteriorate with substantial handling or flexing and exposure to a wide temperature range.

Electrical

Characteristic Impedance: approximately 55 ohms
Capacitance: 22–23 picofarads per foot
Velocity of Propagation: approximately 80% (of the speed of light).

Other

Finished cable diameter: less than 0.060 inch
Maximum continuous operating temperature: in the 150° C. range
Flexibility and mechanical strength: very good
Solder bath test (230° C.—15 sec.): no effect.

EXAMPLE 2

A small diameter coaxial cable was fabricated according to the method described in Example 1. A 30 AWG central conductive member comprised of seven copper strands and having a combined diameter of 0.012 inch was braided over to a braid density of 10 to 15 picks per inch with eight filaments of ethylene-chlorotrifluoroethylene copolymer. Each said filament had a diameter in the range of 0.009 to 0.010 inch. A continuous layer of polyparabanic acid was then applied over the open weave of the braided layer following the teachings of Example 1, and using a polyparabanic acid tape 0.001 inch in thickness and 0.187 inch in width in such a manner so as to produce a 20–25 percent overlap. An acrylic topcoat layer of the same material used in Example 1 was applied in the same manner as described therein. Following this, an outer conductive member and a protective layer were applied in a manner well known to the art.

The resulting cable had a characteristic impedance of 75 ohms and demonstrated useful dielectric properties.

EXAMPLE 3

A small diameter coaxial cable was fabricated according to the method described in Example 1. A 32 AWG solid copper central conductive member having a 0.008 inch diameter was braided over to a braid density of 10–15 picks per inch with eight filaments of ethylene-chlorotrifluoroethylene copolymer. Each said filament had a diameter in the range of 0.009 to 0.010 inch. A continuous layer of polyparabanic acid was then applied over the open weave of the braided layer following the teachings of Example 1, using a polyparabanic acid tape 0.001 inch in thickness and 0.187 inch in width in such a manner so as to produce a 20–25 percent overlap. An acrylic topcoat layer of the same material used in Example 1 was applied in the same manner as described therein. Following this, an outer conductive member and a protective layer were applied in a manner well known to the art.

The resulting cable had a characteristic impedance of 90 ohms and demonstrated useful dielectric properties.

What I claim and desire to protect by Letters Patent is:

1. A coaxial cable having improved strength properties over a wide temperature range, comprising:

(a) an inner conductor;

(b) a dielectric system comprising:

(i) a first layer of braided high tensile strength polymeric fluorocarbon filaments surrounding said inner conductor in an open weave along the length of the inner conductor, said filaments having a tensile strength of at least 40,000 psi and a dielectric constant of less than 2.8;

(ii) a second layer consisting of a polymeric film which remains stable at temperatures of up to 150° C. surrounding circumferentially the first layer and providing a continuous skin enclosing the first layer; and (iii) a third layer consisting of a crosslinked polymeric lacquer surrounding circumferentially the second layer and providing a continuous skin enclosing the second layer;

(c) an outer conductor disposed circumferentially about the dielectric system; and (d) an outer protective layer surrounding circumferentially the outer conductor.

2. A coaxial cable of claim 1 in which the second layer of polymeric film of the dielectric system is applied in the form of a tape helically wrapped about said first layer.

3. A coaxial cable of claim 2 in which the second layer of polymeric film is polyparabanic acid film.

4. A coaxial cable of claim 2 in which the second layer of polymeric film is a polyimide film.

5. A coaxial cable of claim 2 in which the second layer of polymeric film is a polyester film.

6. A coaxial cable of claim 3 in which the third layer is a crosslinked polymer of methyl methacrylate.

7. A coaxial cable of claim 4 in which the third layer is a crosslinked polymer of methyl methacrylate.

8. A coaxial cable of claim 5 in which the third layer is a crosslinked polymer of methyl methacrylate.

9. A method of making a coaxial cable having improved strength properties over a wide temperature range, comprising:

(a) covering a metallic conductor circumferentially with a first layer of braided high tensile strength polymeric fluorocarbon filaments in an open weave along the length of the conductor, said filaments having a tensile strength of at least 40,000 psi and a dielectric constant of less than 2.8;

(b) covering the first layer circumferentially with a second layer of a polymeric film thereby providing a continuous skin enclosing the first layer; and (c) covering the second layer circumferentially with a third layer consisting of a cross-linked polymeric lacquer thereby providing a continuous skin enclosing the second layer;

(d) covering the third layer circumferentially with an outer conductor; and (e) covering the outer conductor circumferentially with an outer protective layer.

* * * * *